US010344698B2

(12) United States Patent
Barth et al.

(10) Patent No.: US 10,344,698 B2
(45) Date of Patent: Jul. 9, 2019

(54) METHOD FOR OPERATING INJECTORS OF AN INJECTION SYSTEM

(71) Applicant: Continental Automotive GmbH, Hannover (DE)

(72) Inventors: Reinhard Barth, Pielenhofen (DE); Roman Etlender, Ingolstadt (DE)

(73) Assignee: CONTINENTAL AUTOMOTIVE GMBH, Hanover (DE)

( * ) Notice: Subject to any disclaimer, the term of this patent is extended or adjusted under 35 U.S.C. 154(b) by 203 days.

(21) Appl. No.: 15/038,606

(22) PCT Filed: Nov. 13, 2014

(86) PCT No.: PCT/EP2014/074458
§ 371 (c)(1),
(2) Date: May 23, 2016

(87) PCT Pub. No.: WO2015/074939
PCT Pub. Date: May 28, 2015

(65) Prior Publication Data

US 2016/0298566 A1 Oct. 13, 2016

(30) Foreign Application Priority Data

Nov. 21, 2013 (DE) ..... 10 2013 223 756

(51) Int. Cl.
*F02D 41/24* (2006.01)

(52) U.S. Cl.
CPC ..... *F02D 41/2467* (2013.01); *F02D 41/2432* (2013.01); *F02D 41/2464* (2013.01);
(Continued)

(58) Field of Classification Search
CPC ..... F02D 41/2467; F02D 41/2464; F02D 41/2432; F02D 2200/0616;
(Continued)

(56) References Cited

U.S. PATENT DOCUMENTS 4,421,088 A 12/1983 Seilly ..... 123/447
6,223,730 B1 * 5/2001 Hasegawa ..... F02D 41/047 123/491

(Continued)

FOREIGN PATENT DOCUMENTS

DE 3126393 A1 4/1982 ..... F02D 1/08
DE 102007038985 A1 2/2000 ..... F02D 41/20

(Continued)

OTHER PUBLICATIONS

German Office Action, Application No. 102013223756.1, 7 pages, dated Sep. 2, 2014.

(Continued)

*Primary Examiner* — Joseph J Dallo
(74) *Attorney, Agent, or Firm* — Slayden Grubert Beard PLLC

(57) ABSTRACT

The present disclosure provides a method for operating injectors of an injection system, which has a pressure accumulator (rail), of an internal combustion engine, in which needle movement of the injectors is controlled directly by way of an actuator. The method may comprise: determining an actual injection quantity of each injector of the injection system via a fuel quantity which is requested at a pump of the injection system for each injector for a predefined time period or via a pressure loss in the pressure accumulator, the pressure loss brought about by way of the injection operation; comparing the determined actual fuel quantity with a setpoint fuel quantity; and if a deviation is determined in an injector, carrying out an open/closed loop control method for reducing/eliminating the determined deviation.

7 Claims, 2 Drawing Sheets

(52) U.S. Cl.
CPC ..... *F02D 2200/0602* (2013.01); *F02D 2200/0614* (2013.01); *F02D 2200/0616* (2013.01); *F02D 2200/0618* (2013.01)

(58) Field of Classification Search
CPC ..... F02D 2200/0614; F02D 2200/0602; F02D 2200/0618
See application file for complete search history.

(56) References Cited

U.S. PATENT DOCUMENTS 6,227,177 B1 * 5/2001 Yamafuji ..... F02D 41/0042 123/399
6,349,702 B1 * 2/2002 Nishiyama ..... F02D 41/3836 123/447
6,539,921 B1 * 4/2003 Matsumura ..... F02D 41/2474 123/456
7,178,507 B1 2/2007 Gangopadhyay ..... 123/435
2002/0117152 A1 * 8/2002 Fallahi ..... F02D 41/20 123/490
2003/0056761 A1 * 3/2003 Yomogida ..... F02D 41/3809 123/461
2003/0111934 A1 * 6/2003 Rueger ..... F02D 41/2096 310/317
2003/0200957 A1 * 10/2003 Shinogle ..... F02D 41/365 123/480
2003/0234007 A1 * 12/2003 Hokazono ..... F02D 41/3836 123/478
2007/0290573 A1 * 12/2007 Sykes ..... F02D 41/2096 310/311
2008/0040018 A1 * 2/2008 Katoch ..... F02D 13/0215 701/103
2009/0045267 A1 * 2/2009 Sutter ..... F02D 41/2096 239/102.2
2010/0199951 A1 8/2010 Cinpinski et al. ..... 123/456
2010/0275885 A1 * 11/2010 Becker ..... F02D 41/2096 123/478
2011/0000465 A1 * 1/2011 Stoecklein ..... F02D 41/2096 123/478
2011/0120420 A1 * 5/2011 Gencbay ..... F02D 41/2416 123/478
2011/0192372 A1 * 8/2011 Guglielmone ..... F02D 41/401 123/294
2012/0239278 A1 9/2012 Becker et al. ..... 701/105
2013/0116912 A1 * 5/2013 Altenschmidt ..... F02D 35/023 701/103
2014/0311459 A1 * 10/2014 Katsurahara ..... F02D 41/247 123/478
2015/0051813 A1 * 2/2015 Ramundo ..... F02D 41/3005 701/104

FOREIGN PATENT DOCUMENTS

DE 112006003029 T5 10/2008 ..... F02M 7/00
DE 102007052096 A1 5/2009 ..... F02D 19/06
DE 102009029590 A1 3/2011 ..... F02D 41/20
EP 0488362 A2 6/1992 ..... F02D 41/24
EP 1854987 A2 11/2007 ..... F02D 41/24
EP 2666996 A1 11/2013 ..... F02D 41/00
WO 2008/092779 A1 8/2008 ..... F02D 41/24
WO 2015/074939 A2 5/2015 ..... F02D 41/24

OTHER PUBLICATIONS

International Search Report and Written Opinion, Application No. PCT/EP2014/074458, 18 pages, dated May 19, 2015.

* cited by examiner

METHOD FOR OPERATING INJECTORS OF AN INJECTION SYSTEM

CROSS-REFERENCE TO RELATED APPLICATIONS

This application is a U.S. National Stage Application of International Application No. PCT/EP2014/074458 filed Nov. 13, 2014, which designates the United States of America, and claims priority to DE Application No. 10 2013 223 756.1 filed Nov. 21, 2013, the contents of which are hereby incorporated by reference in their entirety.

TECHNICAL FIELD

The present disclosure relates to injectors of an injection system, and, in particular, a system which includes a pressure accumulator (rail) of an internal combustion engine, and a method for controlling the needle movement of the injectors directly by way of an actuator.

BACKGROUND

Injectors of internal combustion engines have production tolerances after their manufacture. As a consequence, each injector outputs a different fuel quantity upon an actuation with the same signal. It goes without saying that an attempt is made to keep said deviations as small as possible.

The injectors which are addressed here are those, in which the movement of the needle of the injector is controlled by way of an actuator directly, that is to say without a servo-valve, in particular via direct contact, via levers, or via a hydraulic coupling. Directly controlled injectors of this type have no operating leakage. Therefore, the fuel quantity which is removed from the pressure accumulator during one cycle corresponds (considered dynamically) to the injection quantity which an injector has introduced into the combustion chamber of the internal combustion engine.

In injectors of this type with a directly coupled nozzle needle, the deviations in the injection quantity which are mentioned in the above text can be standardized as follows:

Type 1: deviation in opening and closing times

Type 2: deviation in the maximum rate

Deviations which consist of a combination of the two types specified above are likewise possible.

Various methods and strategies are known, in order to reduce or eliminate deviations of this type. In a first known method, classification of the corresponding injectors takes place. Here, the injectors are measured at certain points, and the corresponding deviations are encoded. Subsequently, the encoding is transmitted to the control device of the internal combustion engine, in order for it to be possible to apply corresponding adoption functions.

In another method, a closing time regulation is used to eliminate deviations of type 1. Here, the closing times of the injectors are detected and the deviations are corrected.

In yet another method, cylinder pressure indexing is carried out for combustion process checking and cylinder balancing. In another method, cylinder balancing and quantity estimation take place on the basis of a crankshaft acceleration signal.

The abovementioned methods are as a rule complicated and capable of improvement in relation to the accuracy of the obtained results.

SUMMARY

The present disclosure provides methods by way of which deviations in the fuel quantities to be metered by injectors can be determined and reduced/eliminated in a particularly simple and accurate way.

In some embodiments, a method comprises the following steps:

determining of the actual injection quantity of each injector of the injection system via the fuel quantity which is requested at the pump of the injection system for each injector for a predefined time period or via the pressure loss in the pressure accumulator, which pressure loss is brought about by way of the injection operation;

comparing of the determined requested fuel quantity or the determined pressure loss with a setpoint fuel quantity or a setpoint pressure loss for each injector; and, if a deviation is determined in an injector, carrying out of an open/closed loop control method for reducing/eliminating the determined deviation.

In some embodiments, a method may comprise the following steps:

determining of the actual injection quantity of each injector of the injection system via the fuel quantity which is requested at the pump of the injection system for each injector for a predefined time period or via the pressure loss in the pressure accumulator, which pressure loss is brought about by way of the injection operation;

comparing of the determined requested fuel quantity or the determined pressure loss among the injectors of the injection system; and if a deviation is determined in an injector, carrying out of an open/closed loop control method for reducing/eliminating the determined deviation.

The embodiments described above utilize the fact that directly controlled injectors have no operating leakage. Since the fuel quantity which is removed from the pressure accumulator during one cycle therefore corresponds to the injection quantity which an injector has injected into the combustion chamber, a very precise estimation of the injection quantity is possible, to be precise firstly via the pressure loss in the pressure accumulator and secondly via the quantity which is requested at the pump. In order to detect the actual injection quantity, the quantity which is requested from the pump or the pressure loss in the pressure accumulator is therefore determined in the method according to the invention. Here, the quantity which is requested at the pump is typically likewise determined from the pressure profile in the pressure accumulator by way of a dedicated regulator. This method functions particularly satisfactorily in the case of a synchronous running piston pump which can meter the fuel quantity to the cylinders individually.

After the determining of the actual injection quantity, the determined requested fuel quantity or the determined pressure loss is compared with a setpoint fuel quantity or a setpoint pressure loss for each injector in the first embodiment of the method according to the invention. Said setpoint fuel quantity or said setpoint pressure loss is stored on the control device of the internal combustion engine. If a deviation is determined in an injector between the actual and setpoint values, an open/closed loop control method is then carried out for reducing/eliminating the determined deviation.

In the second example described above, the determined requested fuel quantity or the determined pressure loss is calibrated among the injectors of the injection system. If a deviation is determined in an injector, a corresponding open/closed loop control method is carried out for reducing/eliminating the determined deviation.

In some embodiments, pressure regulating parameters are used for checking and correcting the injection quantities. Here, the correlation between a volume-controlled pressure regulation and an operating leakage-free injector actuation is utilized for fuel metering.

Using these methods, there is no longer any necessity to encode the injectors. Injector to injector deviations can be detected automatically. Variations within a system of a plurality of injectors can be largely eliminated. Furthermore, there is the possibility of detecting a "drift" of an injector within the system, it being possible for a correction of a drift of this type to be carried out. Cylinder balancing is possible, even and above all at high loads and rotational speeds. Conclusions about throughflow changes in combination with closing point detections for long injection times and conclusions about energy requirement for correcting the opening characteristic in combination with closing point detection for short injection times can be carried out.

In some embodiments, a mean value or median value is formed from the determined requested fuel quantities or the determined pressure losses, and all deviations of the values of the injectors from the mean value or median value are determined, in order to carry out the calibration. A correction in the direction of the mean value or median value can then be carried out. It can also be determined in said method variant and the preceding method variant whether a deviation lies outside the correctable corridor.

In some embodiments, the correction of the deviation is carried out via a suitable open/closed loop control method in the first and second embodiment of the method according to the invention. For example, a closing time regulation can be carried out as open/closed loop control method. A closing time regulation of this type is known per se, the opening and/or closing time of an injector being detected and being compared with corresponding setpoint values. A closing time regulation of this type may be combined with the determining of the actual injection quantity via the fuel quantity which is requested from the pump or via the pressure loss in the pressure accumulator.

In some embodiments, in addition to a closing time regulation, a correction is carried out via the adaptation of the actuation duration of the injector. In another method variant, in addition to a closing time regulation, a correction is carried out by way of adaptation of the actuator energization.

Method variants of this type can be carried out, for example, when a deviation of type 1 (deviation in opening and closing times) is corrected and the remaining deviation which is detected according to the method according to the invention can be designated unambiguously as a deviation of type 2 (deviation in the maximum rate). If a correction is carried out via the adaptation of the actuation duration of the injector, longer energization takes place here, for example, in the case of upward correction of the quantity and shorter energization of the actuator takes place in the case of the downward correction of the quantity. In the case of the correction by way of adaptation of the actuator energization, an increase/reduction in the energy or modification of the actuation profile can be carried out, for example.

The methods offer the advantage, in particular, that it can be carried out as an on-board diagnosis during the normal operation of the injection system. Automatic on-board detection of the injector to injector deviations can thus be carried out. Said on-board execution also comprises the subsequent open/closed loop control method.

In some embodiments, a deviation (type 1) in the opening and/or closing point of an injector is corrected via another method, and the remaining deviation (type 2) is determined and is reduced/eliminated via an open/closed loop control method.

Here, a deviation in the opening and/or closing time (type 1 mentioned at the outset) is determined and corrected. The deviation of type 2 mentioned at the outset (deviation in the maximum injection rate) which then still remains as a rule is then determined by way of the method according to the invention (can be designated unambiguously as a deviation of type 2). Said deviation can then be reduced/eliminated via an open/closed loop control method, for example via the abovementioned adaptation of the actuation duration of the injector or via the abovementioned adaptation of the actuator energization.

BRIEF DESCRIPTION OF THE DRAWINGS

The invention will be explained in detail in the following text using exemplary embodiments in conjunction with the drawing, in which.

DETAILED DESCRIPTION

The method described here for operating injectors of an injection system, which has a pressure accumulator (rail), of an internal combustion engine is a method which is carried out as an on-board diagnosis during the normal operation of the injection system. The injectors of said injection system are those, the needle movement of which is controlled directly by way of an actuator, that is to say those which operate without a servovalve. The internal combustion engine may be a diesel engine.

In step 1 of the method which can also be called a calibrating method of the injectors, the actual injection quantity of each injector of the injection system is determined via the fuel quantity which is requested at the pump of the injection system for each injector for a predefined time or via the pressure loss in the pressure accumulator (rail), which pressure loss is brought about by way of the injection operation. In steps 2 and 3, setpoint values are provided for the fuel quantity which is requested at the pump or the pressure loss in the pressure accumulator, which setpoint values are stored, for example, in the control device of the internal combustion engine. In step 4, the determined requested fuel quantity or the determined pressure loss is compared with the setpoint fuel quantity or the setpoint pressure loss for each injector. If a deviation in an injector is determined, an open/closed loop control method is carried out in step 5, in order to reduce or to eliminate the determined deviation and in this way to carry out a correction of the injection quantity which is injected by the corresponding injector, for example a closing time regulation.

Figure 1:
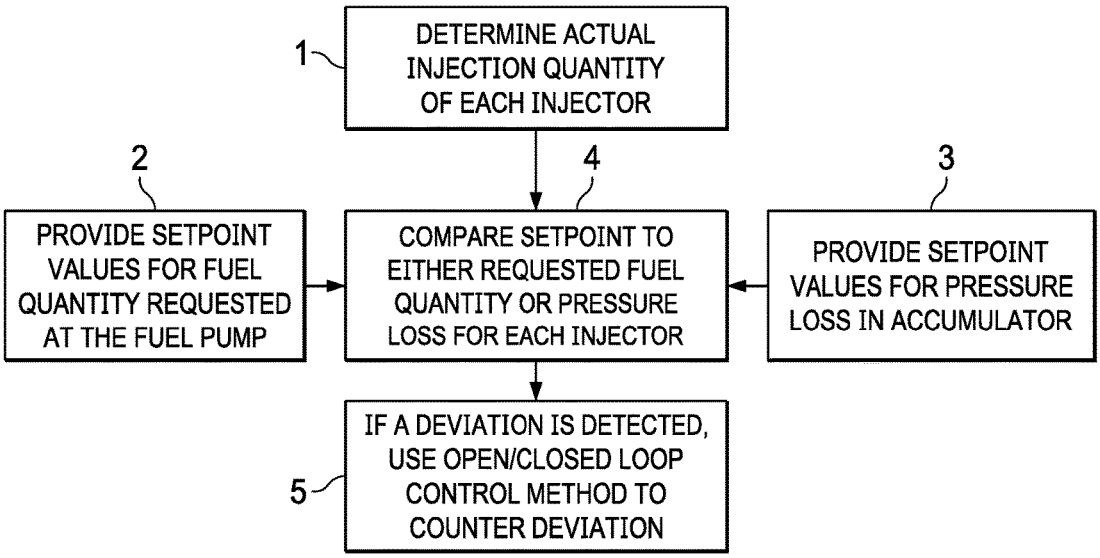
FIG. 1 shows a flow chart of a first embodiment of a method for operating injectors.
Figure 2:
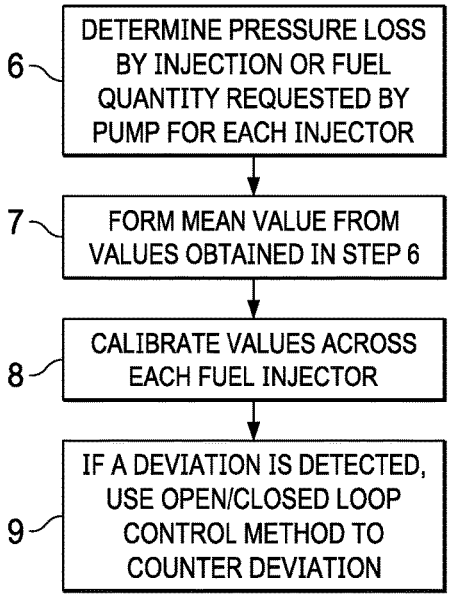
FIG. 2 shows a flow chart of a second embodiment of a method of this type.

In the example method variant shown in FIG. 2, the actual injection quantity of each injector is likewise determined via the fuel quantity which is requested at the pump of the injection system for each injector for a predefined time or via the pressure loss in the pressure accumulator, which pressure loss is brought about by way of the injection operation (step 6). The diesel engine which is addressed here has four cylinders and therefore also four injectors, the actual injection quantities being determined for all four injectors. A mean value is formed from the obtained values in step 7, and a calibration of the determined requested fuel quantity or the determined pressure loss among the four injectors of the injection system takes place in step 8. If a deviation from the mean value is determined in an injector, a corresponding open/closed loop control method is carried out for reducing/eliminating the determined deviation (step 9).

Figure 3:
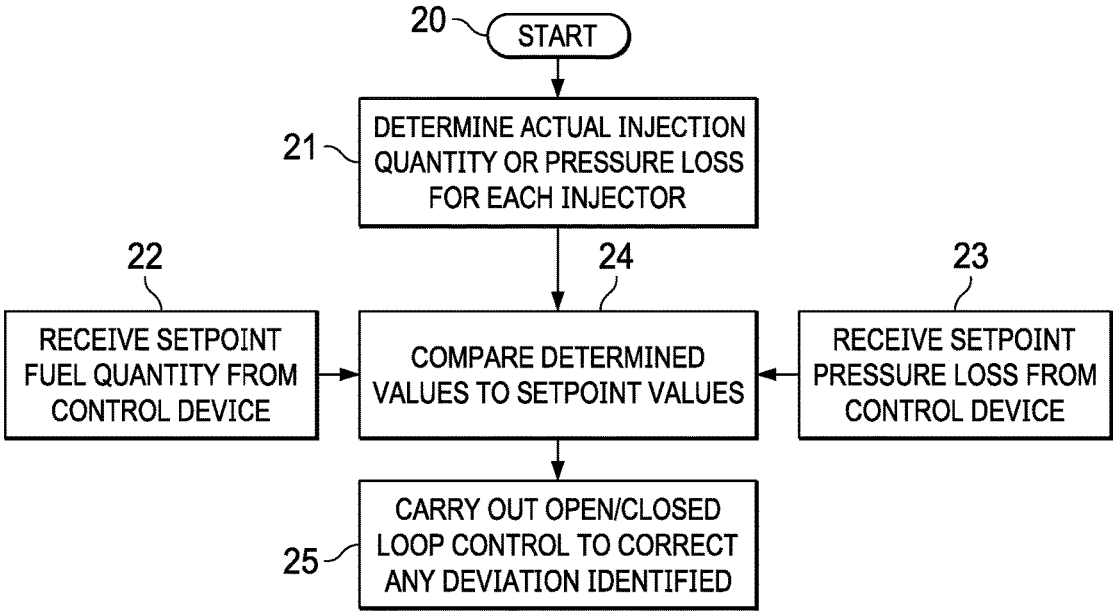
FIG. 3 shows a flow chart of a third embodiment of a method of this type.

In the example method variant which is shown in FIG. 3, a deviation in the opening and/or closing time of an injector of the injection system is corrected via another method (step 20). The remaining deviation which was not able to be corrected by way of the other method is then determined and corrected by way of the method according to the invention. Here, in step 21, in the above-described way, the actual injection quantity of each injector of the injection system is determined via the fuel quantity requested at the pump of the injection system for each injector for a predefined time or via the pressure loss in the pressure accumulator, which pressure loss is brought about by way of the injection operation. In steps 22 and 23, a setpoint fuel quantity or a setpoint pressure loss is made available for each injector from the control device. The determined requested fuel quantity or the determined pressure loss are compared with the setpoint fuel quantity or the setpoint pressure loss in step 24. If a deviation in an injector is determined, a corresponding open/closed loop control method is carried out in step 25. In this way, the remaining deviation (type 2) can be corrected. The open/closed loop control method which is applied can comprise an adaptation of the actuation duration of the injector as additional correction or a correction by way of adaptation of the actuator energization.

What is claimed is:

1. A method for operating injectors of an injection system including a pressure accumulator, of an internal combustion engine, the method comprising:

directly controlling needle movement of the injectors with respective actuators;

correcting a deviation in at least one of an opening time or a closing time of one of the injectors using a closing time regulation of the one of the injectors by comparing the opening time or the closing time with a corresponding setpoint value;

determining an actual injection quantity of each injector of the injection system via a fuel quantity which is requested at a pump of the injection system for each injector for a predefined time period or via a pressure loss in the pressure accumulator, the pressure loss brought about by way of individual injections;

comparing the determined actual fuel quantity with a setpoint fuel quantity; and if a remaining deviation is determined in an injector, carrying out a correction by adapting an actuation duration or an energization of the actuator to reduce the determined deviation.

2. A method for operating an internal combustion engine comprising injectors and, a pressure accumulator, the method comprising:

directly controlling needle movement of the injectors with respective actuators;

correcting a deviation in at least one of an opening time or a closing time of a particular injector by regulating the closing time based on a comparison of the opening time or the closing time with a corresponding setpoint value;

determining an actual injection quantity of each injector of the injection system via a fuel quantity requested at the pump of the injection system for each injector for a predefined time period or via the pressure loss in the pressure accumulator brought about by individual injection operations;

calculating a mean value or a median value based on the determined actual injection quantities;

comparing the determined actual injection quantity among the injectors of the injection system, including comparing all deviations of individual injection quantities from the mean value or the median value; and if a remaining deviation is determined in an injector, carrying out a correction by adapting an actuation duration or an energization of the actuator to recalibrate the particular injector.

3. The method as claimed in claim 1, further comprising determining whether a magnitude of a particular deviation exceeds a correctable maximum value.

4. The method as claimed in claim 1, wherein the method is carried out as an on-board diagnosis during normal operation of the internal combustion engine.

5. A method for operating injectors of an injection system including a pressure accumulator, of an internal combustion engine, the method comprising:

directly controlling needle movement of the injectors with respective actuators;

correcting a deviation in the closing time of an injector via regulating the closing time of the respective injector, and correcting any remaining deviation by:

determining an actual injection quantity of each injector of the injection system via a fuel quantity which is requested at a pump of the injection system for each injector for a predefined time period or via a pressure loss in the pressure accumulator, the pressure loss brought about by way of individual injections;

comparing the determined actual fuel quantity with a setpoint fuel quantity; and if a deviation is determined in an injector, carrying out an open or a closed loop control method to reduce the determined deviation.

6. The method as claimed in claim 2, further comprising determining whether a magnitude of a particular deviation exceeds a correctable maximum value.

7. The method as claimed in claim 2, wherein the method is carried out as an on-board diagnosis during normal operation of the internal combustion engine.

* * * * *